US006024440A

United States Patent [19]

Murthy et al.

[11] Patent Number: 6,024,440

[45] Date of Patent: Feb. 15, 2000

[54] NOZZLE ARRAY FOR PRINTHEAD

[75] Inventors: Ashok Murthy; James Harold Powers; John Dennis Zbrozek, all of Lexington, Ky.

[73] Assignee: Lexmark International, Inc., Lexington, Ky.

[21] Appl. No.: 09/004,236

[22] Filed: Jan. 8, 1998

[51] Int. Cl.[7] ..... B41J 2/05; B41J 2/14

[52] U.S. Cl. ..... 347/65; 347/40; 347/47

[58] Field of Search ..... 347/40, 47, 65, 347/62, 63

[56] References Cited

U.S. PATENT DOCUMENTS

| | | | |
|---|---|---|---|
| 4,367,480 | 1/1983 | Kotoh . | |
| 4,803,499 | 2/1989 | Hayamizu | 346/140 R |
| 4,989,016 | 1/1991 | Gatten et al. | 346/1.1 |
| 5,121,143 | 6/1992 | Hayamizu | 346/140 R |
| 5,124,720 | 6/1992 | Schantz | 346/1.1 |
| 5,189,437 | 2/1993 | Michaelis et al. . | |
| 5,208,605 | 5/1993 | Drake | 346/1.1 |
| 5,291,226 | 3/1994 | Schantz et al. | 346/140 R |
| 5,412,412 | 5/1995 | Drake et al. . | |
| 5,414,916 | 5/1995 | Hayes | 29/25.35 |
| 5,581,284 | 12/1996 | Hermanson | 347/43 |
| 5,587,730 | 12/1996 | Karz | 347/43 |
| 5,635,968 | 6/1997 | Bhaskar et al. | 347/59 |
| 5,640,183 | 6/1997 | Hackleman | 347/40 |
| 5,790,151 | 8/1998 | Mills . | |
| 5,808,631 | 9/1998 | Silverbrook | 347/9 |
| 5,818,479 | 10/1998 | Reinecke et al. . | |
| 5,838,343 | 11/1998 | Chapin et al. | 347/40 X |
| 5,844,585 | 12/1998 | Kurashima et al. . | |

*Primary Examiner*—Matthew S. Smith
*Attorney, Agent, or Firm*—David E. LaRose; John Victor Pezdek

[57] ABSTRACT

A nozzle plate for an inkjet printer including a first nozzle array having a plurality of nozzles, each of which is positioned to correspond to a desired print location, with the print location of each of the nozzles of the first array being different from one another; and a second nozzle array having a plurality of nozzles, each of which is positioned to correspond to a desired print location, with the print location of each of the nozzles of the second array corresponding to one of the print locations of the first array such that the first and second arrays each have one nozzle corresponding to each desired print location.

36 Claims, 5 Drawing Sheets

NOZZLE ARRAY FOR PRINTHEAD

FIELD OF THE INVENTION

This invention relates generally to printheads for thermal inkjet print cartridges. More particularly, this invention relates to nozzle plates and to the arrangement of nozzles and ink channels on nozzle plates of printheads.

BACKGROUND OF THE INVENTION

Thermal inkjet printers utilize print cartridges having printheads for directing ink droplets onto a medium, such as paper, in patterns corresponding to the indicia to be printed on the paper. In general, ink is directed from a reservoir via flow paths to orifices or nozzles for release onto the paper. Heaters are provided adjacent the nozzles for heating ink supplied to the nozzles to vaporize a component in the ink in order to propel droplets of ink through the nozzle holes to provide a dot of ink on the paper. During a printing operation the print head is moved relative to the paper and ink droplets are released in patterns corresponding to the indicia to be printed by electronically controlling the heaters to selectively operate only the heaters corresponding to nozzles through which ink is to be ejected for a given position of the printhead relative to the paper.

Given the foregoing, it will be appreciated that failure of ink to be ejected from even one nozzle, such as may result from heater failure or nozzle clogging, can detrimentally affect printer performance and print quality.

Accordingly it is an object of the present invention to provide an improved inkjet printhead.

Another object of the present invention is to provide a printhead which offers enhanced performance as compared to conventional printheads.

A further object of the present invention is to provide a printhead of the character described having an improved nozzle and heater array.

Still another object of the present invention is to provide a printhead of the character described which provides similar ink flow paths to each nozzle location.

An additional object of the present invention is to provide a printhead of the character described having improved reliability.

SUMMARY OF THE INVENTION

Having regard to the foregoing and other objects, the present invention is directed to an inkjet printhead having at least two ink ejection nozzles for each print location.

According to the invention, a printhead assembly is provided having an ink reservoir and ink imparting devices for selectively propelling ink from the printhead in a pattern corresponding to indicia to be printed on a media. In a preferred embodiment, the printhead structure includes a silicon substrate having a plurality of electrically activatable heaters for heating ink and a nozzle plate positioned adjacent the silicon substrate and having a plurality of nozzles, each nozzle being located adjacent a heater for releasing ink from the printhead at desired print locations in response to a print signal to the adjacent heater, wherein the nozzle plate contains at least two nozzles for each print location.

In another aspect, the invention is directed to a nozzle plate for an inkjet printer having at least two nozzle arrays, with each array having a nozzle corresponding to a common print location.

The printhead is operated to alternatively release ink from only one nozzle of the nozzle pair at a time. As will be appreciated, this provides a redundancy feature which tends to reduce the effect caused by malfunction of a nozzle.

For example, nozzle misfunction, that is, the partial or total failure of ink to be ejected through a given nozzle hole may result from various causes including, but not limited to, clogging of a nozzle, heater failure, or restrictions or clogging of the flow path feeding the nozzle. Failure of ink to release as desired reduces or eliminates the release of ink directed toward the paper to be printed for a given print location and thus often results in a reduction in the print quality.

In accordance with the invention, a redundancy feature is provided by providing a printhead having at least two nozzles (and associated heaters) for each print location which operates by alternating between the at least two nozzles such that the effect of an improperly operating heater and/or nozzle is significantly reduced.

BRIEF DESCRIPTION OF THE DRAWINGS

Further advantages of the invention will become apparent by reference to the detailed description of preferred embodiments when considered in conjunction with the following drawings, which are not to scale so as to better show the detail, in which like reference numerals denote like elements throughout the several views, and wherein.

DETAILED DESCRIPTION OF THE INVENTION

Figure 1:
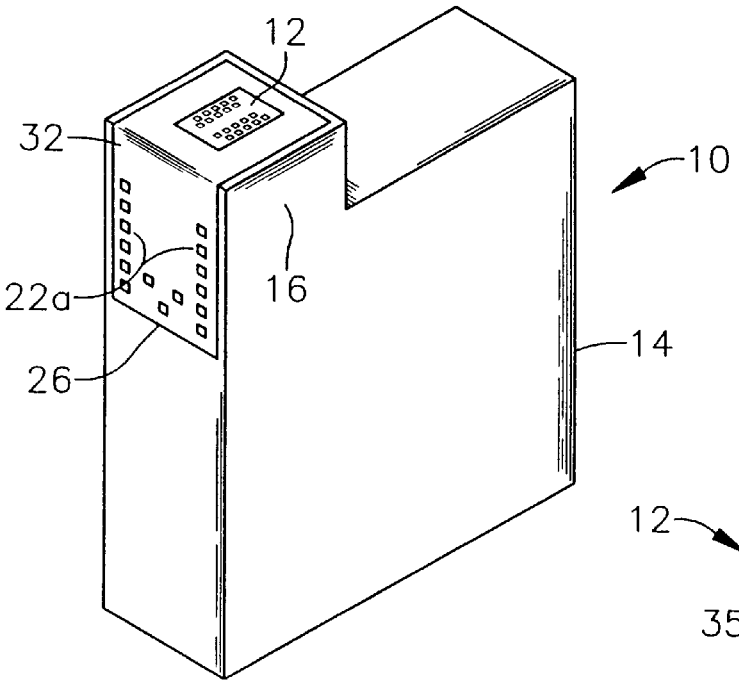
FIG. 1 is a perspective view of an inkjet cartridge having a printhead in accordance with a preferred embodiment of the invention.

Referring now to the figures, there is depicted in FIG. 1 a print cartridge 10 in accordance with a preferred embodiment of the invention for use with inkjet printers. The cartridge 10 includes a printhead assembly 12 located above an ink reservoir 14 provided by a generally hollow plastic body containing ink or a foam insert saturated with ink.

The printhead assembly 12 is preferably located on an upper portion of a nosepiece 16 of the body 14 for transferring ink from the ink reservoir 14 onto a medium to be printed, such as paper, in patterns representing the desired indicia. As used herein, the term "ink" will be understood to refer generally to inks, dyes and the like commonly used for thermal inkjet printers.

Figure 2:
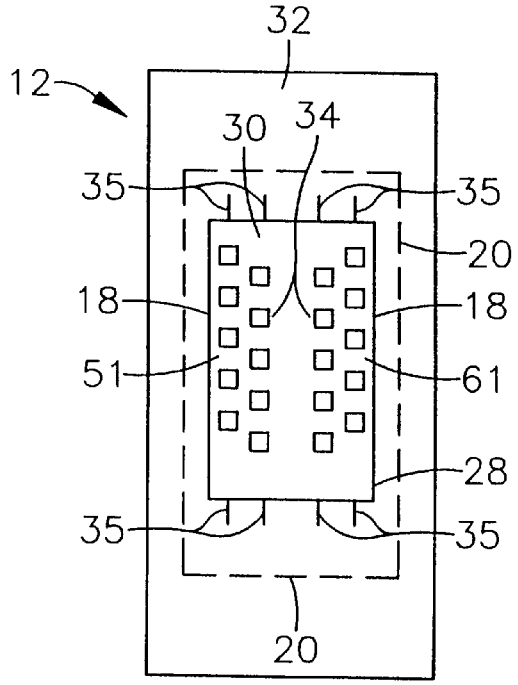
FIG. 2 is an enlarged top plan view of a portion of a printhead for a printer according to the invention.
Figure 3:
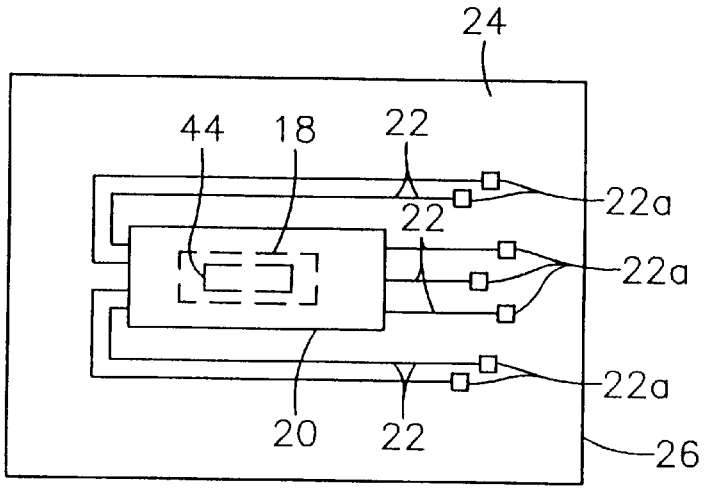
FIG. 3 is a bottom plan view of a printhead for a printer according to the invention.

With additional reference to FIGS. 2 and 3, the printhead 12 preferably includes a nozzle member 18 attached to a silicon member 20, with the silicon member in electrical communication with a plurality of electrically conductive traces 22 provided on a back surface 24 of a polymer tape strip 26. A preferred adhesive attaching the nozzle plate to the substrate is a B-stageable thermal cure resin including, but not limited to phenolic resins, resorcinol resins, urea resins, epoxy resins, ethylene-urea resins, furane resins, polyurethane resins and silicone resins. The thickness of the adhesive layer range from about 1 to about 25 microns.

The nozzle member 18 is preferably provided by a polyimide polymer tape composite material with an adhesive layer on one side thereof, the composite material having a total thickness ranging from about 15 to about 200 microns, with such composite materials being generally referred to as "Coverlay" in the industry. Suitable composite materials include materials available from DuPont Corporation of Wilmington, Del. under the trade name PYRALUX and from Rogers Corporation of Chandler, Ariz. under the trade name R-FLEX. However, it will be understood that the provision of nozzle holes and heaters in accordance with the present invention is applicable to nozzle plates of virtually any material including also, but not limited to, metal and metal coated plastic.

Each trace 22 preferably terminates at a contact pad 22*a* and each pad 22*a* extends through to an outer surface 30 of the tape 26 for contacting electrical contacts of the inkjet printer to conduct output signals from the printer to heater elements on silicon member 20. The traces may be provided on the tape as by plating processes and/or photo lithographic etching. The tape/electrical trace structure is referred to generally in the art as a TAB strip, which is an acronym for Tape Automated Bonding.

The silicon member 20 is hidden from view in the assembled printhead and is attached to nozzle member 18 in a removed area or cutout portion 28 of the tape 26 such that an outwardly facing surface 30 of the nozzle member is generally flush with and parallel to a front surface 32 of the tape 26 for directing ink onto the medium to be printed via a plurality of nozzle holes 34 in flow communication with the ink reservoir 14. The nozzle holes 34 are preferably substantially circular, elliptical, square or rectangular in cross section along an axis parallel to a plane defined by the nozzle member 18.

TAB bonds or wires 35 electrically connect the traces 22 to the silicon member 20 to enable electrical signals to be conducted from the printer to the silicon member for selective activation of the heaters during a printing operation. Thus, the heaters 36 (FIG. 4) are electrically coupled to the conductive traces 22 via the TAB bonds 35 and electrically coupled between the TAB bonds 35 and the contact pads 22*a* for energization thereof in accordance with commands from the printer. In this regard, a demultiplexer 44 (FIG. 3) is preferably provided on the silicon member 20 for demultiplexing incoming electrical signals and distributing them to the heaters 36.

Figure 4:
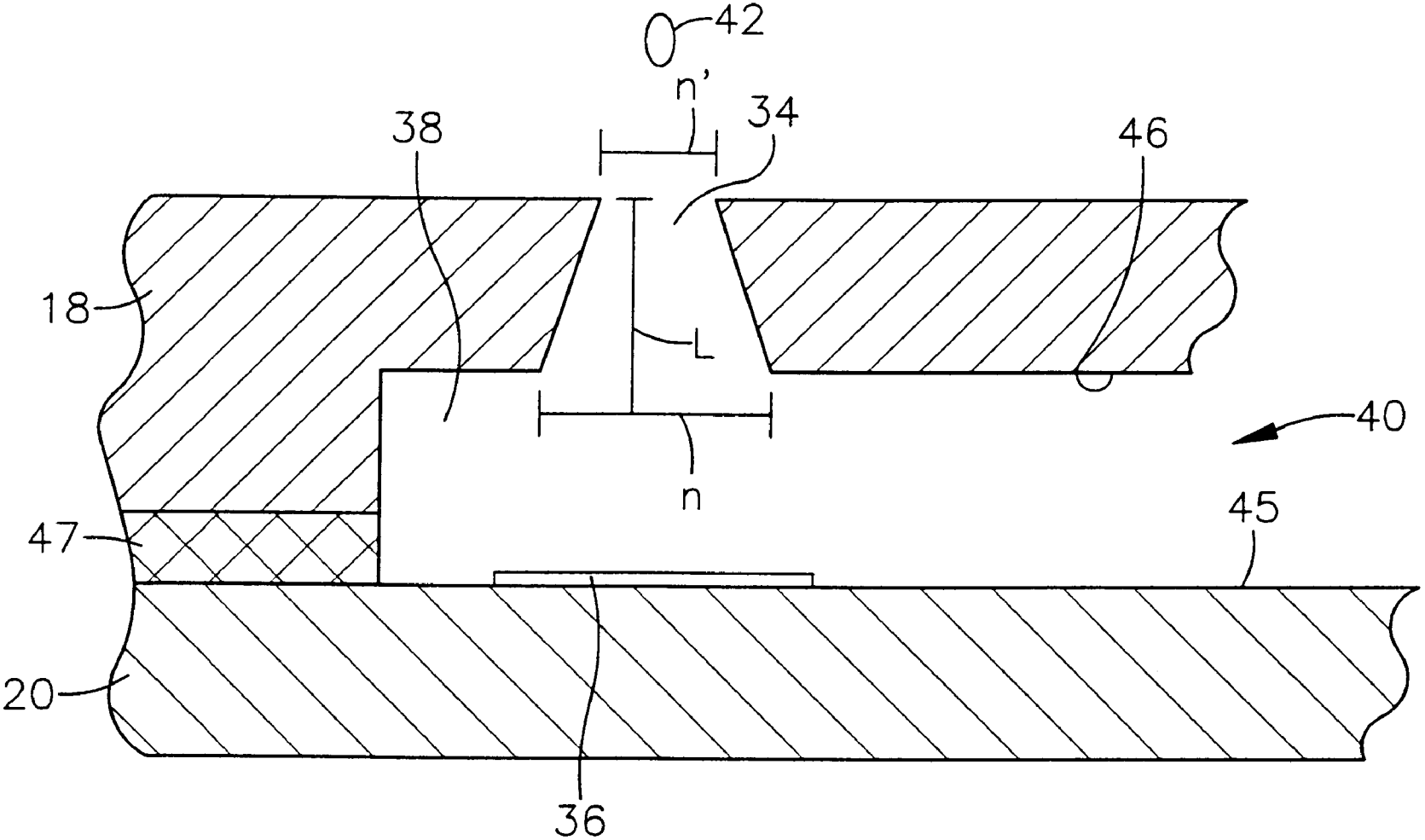
FIG. 4 is an enlarged partial cross-sectional view of a nozzle plate and heater assembly for a printhead according to the invention.

With reference to FIG. 4, the silicon member 20 is preferably a generally rectangular portion of a silicon substrate of the type commonly used in the manufacture of print heads. A plurality of thin film resistors or heaters 36 are provided on the silicon member, with one such heater being located adjacent each one of the nozzles 34 for vaporizing ink for ejection through the nozzles 34. In this regard, each heater 36 is preferably located adjacent a bubble chamber 38 associated with each nozzle hole 34 for heating ink conducted into the chamber via a channel 40 from the ink reservoir 14 to vaporize ink in the chamber and eject it out the nozzle hole 34 for condensing into an ink droplet 42 which strikes the medium to be printed at a desired location thereon.

The silicon member 20 has a size typically ranging from about 2 to about 3 millimeters wide with a length ranging from about 6 to about 12 millimeters long and from about 0.3 to about 1.2 millimeters in thickness and most preferably from about 0.5 to about 0.8 millimeters thick. The printhead 12 may contain one, two, three or more silicon members 20 and nozzle members 18, however, for purposes of simplifying the description, the printhead assembly will be described as containing only one silicon member 20 and associated nozzle member 18.

The ink travels generally by gravity and capillary action from the reservoir 14 around the perimeter of the silicon member 20 or through a central via in the silicon member into the channels 40 for passage into the bubble chambers. The relatively small size of the nozzle holes 34 maintains the ink within the chambers 38 until activation of the associated heaters which vaporizes a volatile component in the ink and voids the chamber after which it refills again by capillary action.

As will be noted, the lower wall of the bubble chamber 38 and the channel 40 associated with each nozzle 34 is provided by the adjacent substantially planar surface 45 of the silicon member. The topographic features of the chambers 38 and the channel 40 are provided by the shape and configuration of a lower surface 46 of the nozzle member 18 which is attached by means of an adhesive layer 47 to the surface 45 of the silicon member 20. The features of the nozzle member 18, such as the nozzle holes 34, bubble chambers 38 and channels 40 are preferably formed in the composite material of the nozzle member 18 by laser ablating to provide configuration as shown in FIGS. 5 and 6.

Figure 5A:
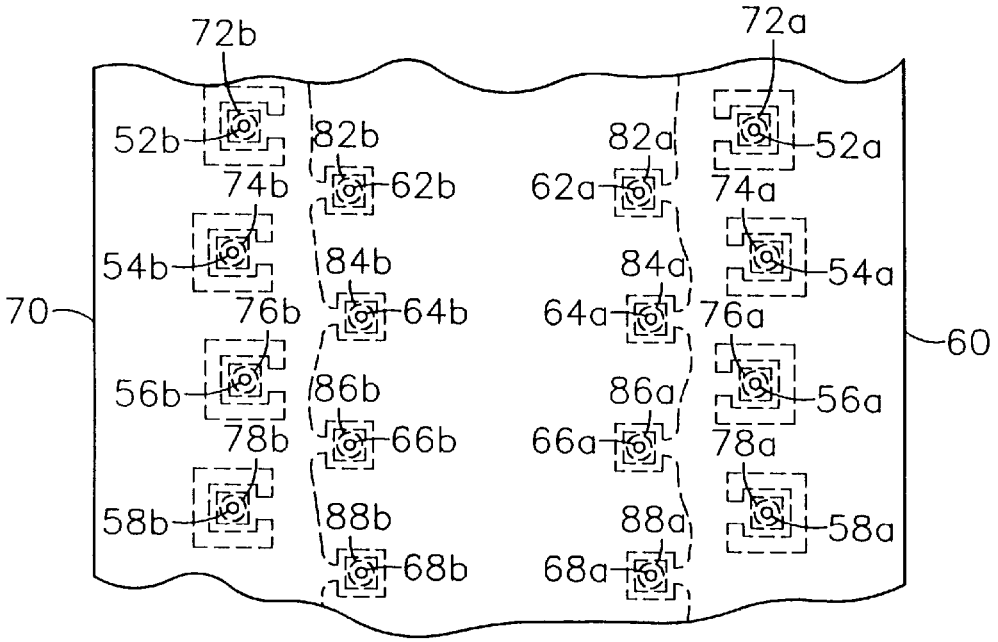
FIG. 5*a* is an enlarged partial top view of a nozzle plate according to the invention.
Figure 5:
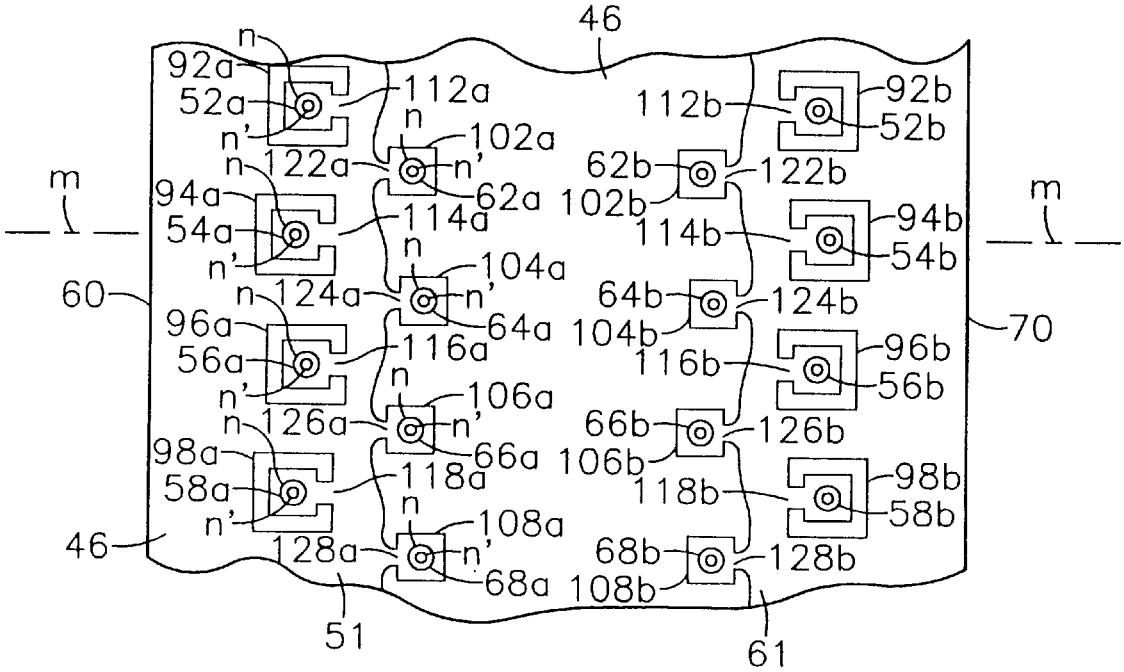
FIG. 5 is an enlarged partial bottom plan view of a nozzle plate for a printhead according to the invention.
Figure 6:
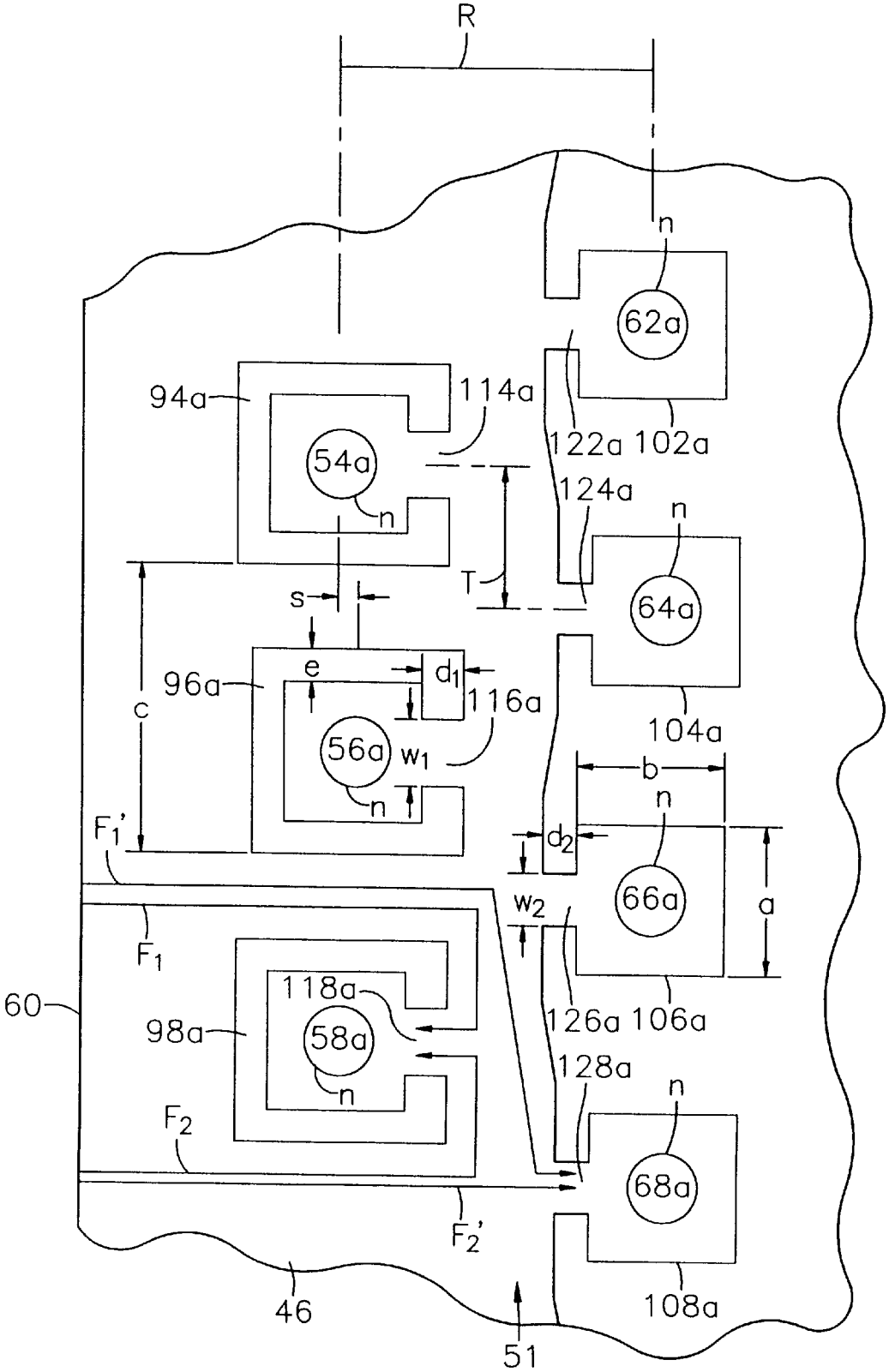
FIG. 6 is an enlarged view of a portion of the nozzle plate of FIG. 5.

Accordingly, and with reference to FIGS. 5–6, the lower surface 46 of the nozzle member 18 is preferably configured to provide a pair of nozzle holes and associated heaters for each print location. The term "print location" will be understood to refer to the location of a nozzle for directing a specific ink bubble or droplet onto the paper to be printed. Conventionally, one nozzle is provided for each print location with sufficient nozzles provided to enable printing of pixel or ink-dot patterns corresponding to virtually any character or image. Thus, failure of a single nozzle can detrimentally affect the printed image.

In accordance with the present invention, there is provided a print head having a pair of nozzles at roughly each print location each nozzle being alternatively activated such that the effect of the failure of a single nozzle of the nozzle pair on the quality of the printed image may be reduced. As will be appreciated, this provides a redundancy feature heretofore unavailable which reduces the effect of a failed nozzle or heater. As used herein, the terminology "alternatively activated" refers to the sequencing associated with ejecting ink from the nozzles of a pair of nozzles by which the nozzles are activated one after the other or one nozzle may be activated two or more times concurrently before the other nozzle is activated.

The individual nozzle holes 34 and heaters 36 are independently numbered as shown in drawing FIGS. 5–6, with the nozzles and heaters of each print location bearing the same integer but with the suffix "a" or "b" to represent their plurality. Accordingly, in a preferred embodiment, the nozzle member 18 is formed to provide a nozzle array 51 positioned adjacent side edge 60 of the silicon member 20 and a nozzle array 61 positioned adjacent side edge 70 of the silicon member 18 (FIG. 5).

Nozzle array 51 includes two rows of nozzles, one row comprising nozzles 52*a*, 54*a*, 56*a*, 58*a*, and the other row comprising nozzles 62*a*, 64*a*, 66*a*, and 68*a*. Nozzle array 61 includes two rows of nozzles one row comprising nozzles 52*b*, 54*b*, 56*b*, 58*b*, and the other row comprising nozzles 62*b*, 64*b*, 66*b*, and 68*b*. As will be seen, an imaginary line may be drawn to bisect between members of a nozzle pair, e.g., bisecting line M drawn between the center of nozzles 54*a* and 54*b*, which nozzles represent the same print location.

With reference now to FIG. 6, it will be noted that the nozzles of the array 51 are arranged in two rows, one row having nozzles 54*a*, 56*a* and 58*a*, and the other row having nozzles 62*a*, 64*a*, 66*a* and 68*a*. Array 61 is similarly configured as to the "b" suffix of the corresponding nozzles in array 51. As noted previously, the "a" and "b" suffixed nozzles of a common-integered nozzles, e.g., nozzles 52*a* and 52*b*, correspond to the same print location and provide a redundancy feature which reduces the effect of the failure of a nozzle or heater at a print location. This is accomplished in a preferred embodiment by alternating between the pair of nozzles (a and b) during a printing sequence.

Heater 72*a* is positioned below nozzle 52*a* and heater 72*b* is positioned below nozzle 52*b* as shown in FIG. 5*a*. Likewise, heaters 74*a*-74*b*, 76*a*-76*b*, 78*a*-78*b* are positioned below nozzle pairs 54*a*-54*b*, 56*a*-56*b*, 58*a*-58*b*, respectively; and heaters 82*a*-82*b*, 84*a*-84*b*, 86*a*-86*b*, 88*a*-88*b* are positioned below nozzle pairs 62*a*-62*b*, 64*a*-64*b*, 66*a*-66*b*, 68*a*-68*b*, respectively. As will be appreciated, the printhead preferably includes more than the eight described nozzle/heater pairs and, in a preferred embodiment includes from about 20 to about 20,000 nozzle/heater pairs, most preferably from about 20 to about 2000 pairs, with the members of each pair provided in separate arrays. In this regard, it is contemplated that at least two arrays be provided. Further arrays may be included to provide even further redundancy, with each array having a nozzle/heater pair for each print location.

With reference again to FIG. 4, in which it will be understood that nozzle hole 34 is representative of each nozzle of the arrays 51 and 61, i.e., nozzles 52–58 and 62–68, the nozzle hole 34 preferably has a length L of from about 10 $\mu$m to about 100 $\mu$m and has tapered walls moving from bubble chamber 38 to the top surface of the nozzle member 18, the entrance opening n being preferably from about 5 $\mu$m to about 80 $\mu$m in width and the exit opening n' being from about 5 $\mu$m to about 80 $\mu$m in width. Each bubble chamber 38 and channel 40, one each of which feeds a nozzle, is sized to provide a desired amount of ink to each nozzle, which volume is preferably from about 1 pl to about 200 pl. In this regard, each bubble chamber 38 preferably has a volume of from about 1 pl to about 400 pl and each channel 40 preferably has a flow area of from about 20 $\mu m^2$ to about 1000 $\mu m^2$.

As noted previously, the features of the nozzle member 18, such as the nozzle holes 34, bubble chambers 38 and channels 40 are preferably formed as by laser ablating a polymeric material to provide configuration as shown in FIGS. 5–6. A preferred method for forming the nozzle holes, bubble chambers and channels is described in copending U.S. patent application Ser. No. 09/004,396, filed concurrently herewith and entitled METHOD FOR MAKING NOZZLE ARRAY FOR PRINTHEAD, which application is incorporated herein by reference in its entirety and assigned to Lexmark International, Inc., the assignee of the present application.

In this regard, the nozzle member 18 is preferably configured to provide a barrier wall for each nozzle location which is shaped to provide a suitable bubble chamber 38 and channel 40 for flow of ink to the nozzle. For example, nozzle member 18 has formed thereon barrier wall 92*a* for nozzle 52*a* and barrier wall 92*b* for nozzle 52*b*. Likewise, barrier walls 94*a*-94*b*, 96*a*-96*b*, 98*a*-98*b* are provided for nozzles 54*a*-54*b*, 56*a*-56*b*, 58*a*-58*b*, respectively, and barrier walls 102*a*-102*b*, 104*a*-104*b*, 106*a*-106*b*, 108*a*-108*b* are provided for nozzles 62*a*-62*b*, 64*a*-64*b*, 66*a*-66*b*, 68*a*-68*b*. All "a" suffixed barrier walls are preferably substantially identical and all "b" suffixed barrier walls are preferably substantially identical. Accordingly, and for the sake of clarity, only representative ones of the barrier walls will be described, it being understood that the additional barrier walls are of like construction.

To facilitate the supplying of ink to the nozzles in a desired manner and to reduce interference from the operation of adjacent nozzles, it is preferred that the nozzles of adjacent rows of an array be spaced apart a distance R corresponding to from about 2 to about 20 heater widths, a "heater width" being from about 10 $\mu$m to about 80 $\mu$m, such that the nozzles of adjacent rows are spaced apart by a distance of from about 20 $\mu$m to about 1000 $\mu$m. In addition, for a printer having a resolution of 600 dpi, it is preferred that each nozzle be longitudinally staggered a distance S of from about 40 $\mu$m to about 400 $\mu$m relative to adjacent nozzles in the same row and latitudinally staggered a distance T of from about 42 $\mu$m to about 84 $\mu$m relative to adjacent nozzles of the other row.

Figure 5B:
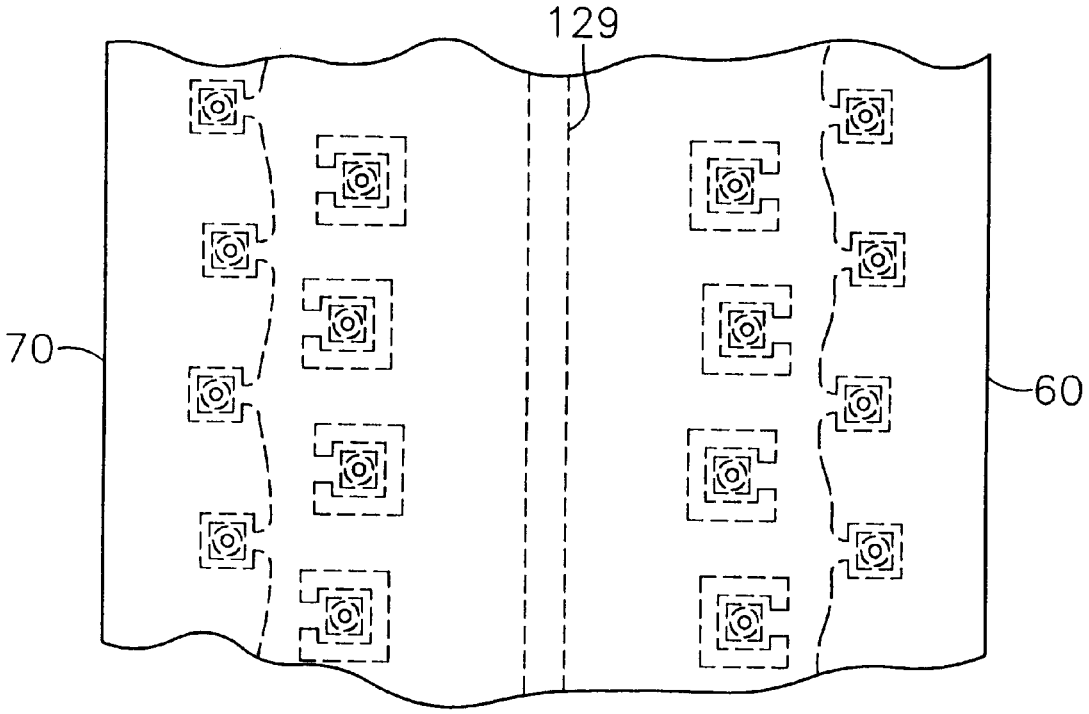
FIG. 5*b* is an enlarged partial top view of another nozzle plate according to the invention.

In addition, it is preferred that the channels or flow paths to the bubble chambers of the nozzles closest to the edges 60 and 70 of the silicon member, that is, channels 112*a*-112*b*, 114*a*-114*b*, 116*a*-116*b*, 118*a*-118*b* which supply ink to the bubble chambers of nozzles 52(*a*),(*b*)-58(*a*), (*b*), respectively, face away from the adjacent edge while channels 122*a*-122*b*, 124*a*-124*b*, 126*a*-126*b*, 128*a*-128*b* which supply ink to the bubble chambers of the nozzles farther from the edges 60 and 70, that is, nozzles 62(*a*)-(*b*), 68(*a*)-(*b*), face toward the adjacent edge. For a silicon member having a central ink via 129, the orientation of the channels for the bubble chambers for each nozzle is reversed as shown in FIG. 5*b*.

As may be appreciated, this orientation of the channels not only provides =multiple flow paths to each nozzle, it also provides flow paths which are of substantially the same length. Thus, for the purpose of an example, it will be noted that flowpaths F1 and F2 (FIG. 6) are available to feed nozzle 58*a* and flowpaths F1' and F2' are available to feed nozzle 68*a*, and that the length and area of flowpath F1, F1', F2 and F2' as measured from the edge 60 of the silicon member are not appreciably different such that the path by which the ink travels to a particular nozzle does not appreciably effect filling of the chamber. In this regard, the flow path to each nozzle is preferably from about 40 $\mu$m to about 300 $\mu$m and most preferably about 85 $\mu$m, with the variance between the flowpaths ranging about ✂ 20%.

Without being bound by theory, and for the purpose of example, it has been observed that the following parameters associated with the positioning and sizing of the barriers and channels may effect the flow of ink to the nozzles:

| parameter | description |
|---|---|
| a | bubble chamber width |
| b | bubble chamber length |
| c | width of the smallest repeating element |
| d1 | length of the bubble chamber entry region |
| d2 | length of the bubble chamber entry region |
| e | wall thickness |
| w1 | width of the bubble chamber entry region |
| w2 | width of the bubble chamber entry region |

Preferred ranges for these parameters are as follows for a printer resolution of 600 dpi and a silicon member having a length of about 14.5 mm, a width of about 0.4 mm and having 2 arrays spaced apart about 804 μm, with 304 nozzles per array.

| parameter | dimension (μm) |
|---|---|
| a | 42 × 10 |
| b | 42 × 10 |
| c | 42⅓ |
| d1 | 20 × 10 |
| d2 | 20 × 10 |
| e | 10 × 5 |
| w1 | 20 × 10 |
| w2 | 20 × 10 |

Accordingly, a significant advantage of the invention relates to the provision of at least two nozzle/heater pairs for each print location. This enables a heretofore unavailable redundancy feature which reduces the detrimental effect of an impaired or failed heater/nozzle. For example, during operation of the printhead, a signal may be received to activate the heater for a desired print location. In the event this heater has failed or its associated nozzle is clogged or otherwise malfunctioning, there will be a lack of ink on the paper to be printed due to the problem with the heater/nozzle. However, due to the redundancy of the printhead of the invention, this lack of ink will only occur during every other print cycle for the desired location, since the corresponding heater/nozzle pair will be activated during the next activation of the instant print location. For example, nozzle/heater 52*a*/72*a* and nozzle/heater 52*b*/72*b* each correspond to the same print location, but are operated alternatively when the print location is activated such that the effect of failure of one of the pair is reduced.

Another significant advantage of the invention is the provision of multiple flow paths to a given nozzle/heater. In this regard, it is noted that nozzle disfunction may result from clogging of the flow path rather than from a problem specific to the heater or nozzle. Thus, provision of more than one flow path, such as the described flow paths F1 and F1', reduces the likelihood of nozzle misfunction due to clogging of flowpaths.

While specific embodiments of the invention have been described with particularity above, it will be appreciated that the invention is equally applicable to different adaptations well known to those skilled in the art.

We claim:

1. An inkjet printhead assembly for use with an inkjet printer, the printhead assembly comprising:

an ink reservoir, and a printhead attached to the reservoir, said printhead containing a plurality of nozzles on a nozzle plate for releasing ink from the printhead toward a medium to be printed, the nozzles being positioned at locations relative to the printhead corresponding to a plurality of desired print locations;

a plurality of resistance heater elements powered by electrical signals generated by a printer controller, each of the heater elements being positioned adjacent to and operatively associated with a nozzle for heating ink for release by the associated nozzle in response to an electrical signal received from the printer controller;

a plurality of ink chambers in flow communication with the reservoir and an associated nozzle for receiving ink to be heated;

a plurality of flow paths for flowably directing ink from the reservoir to each of the chambers, wherein at least two nozzles and their associated heater elements, chambers and flowpaths are provided for each print location.

2. The printhead assembly of claim 1, wherein each of the plurality of flowpaths has a length of from about 40 to about 300 μm.

3. The printhead assembly of claim 1, wherein the printhead is operable for each of the print locations by alternatively activating the heater elements of each print location.

4. The printhead assembly of claim 1, wherein at least one of the nozzles is circular in cross-section along an axis parallel to a plane defined by the nozzle plate.

5. The printhead assembly of claim 1, wherein at least one of the nozzles is square or rectangular in cross-section along an axis parallel to a plane defined by the nozzle plate.

6. The printhead assembly of claim 1, wherein the printhead includes from about 20 to about 20,000 nozzles.

7. The printhead assembly of claim 1, wherein the nozzles for each print location are in vertical alignment and horizontally spaced apart a distance of from about 20 to about 1000 μm.

8. The printhead assembly of claim 1, wherein the nozzles are arranged in spaced apart arrays, with each array containing a nozzle for each print location.

9. The printhead assembly of claim 8, wherein each array contains from about 10 to about 10,000 nozzles.

10. The printhead assembly of claim 9, wherein each array contains two rows of nozzles, with the rows spaced apart from one another by a distance of from about 20 to about 1000 μm.

11. The printhead assembly of claim 10, wherein each nozzle of each row is staggered relative to the nozzle immediately adjacent to it in the same row.

12. A printhead assembly for an inkjet printer, comprising:

an ink reservoir and a printhead attached to the reservoir containing ink ejection means operatively associated with the ink reservoir for selectively ejecting ink from the printhead in patterns corresponding to indicia to be printed by the printer, the ink ejection means comprising a silicon substrate having a plurality of electrically activatable heater elements for heating ink;

a nozzle plate attached to the silicon substrate and having a plurality of nozzles, one each of which is located adjacent one of the heater elements on the substrate for releasing ink heated by the heater elements from the printhead at desired print locations, said nozzle plate having at least two nozzles for each print location.

13. The printhead assembly of claim 12, wherein the printhead is operable for each of the print locations by alternatively activating the heater elements of each print location.

14. The printhead assembly of claim 12, wherein at least one of the nozzles is rectangular in cross section along an axis parallel to a plane defined by the nozzle plate.

15. The printhead assembly of claim 12, wherein the printhead includes from about 20 to about 20,000 nozzles.

16. The printhead assembly of claim 12, wherein the nozzle plate comprises a polyamide polymer and the nozzles are formed by laser ablation of the polyamide polymer.

17. The printhead assembly of claim 12, wherein the nozzles for each print location are in vertical alignment and horizontally spaced apart a distance of from about 20 to about 1000 $\mu$m.

18. The printhead assembly of claim 12, wherein the nozzles are arranged in spaced apart arrays, with each array containing a nozzle for each print location.

19. A nozzle plate for an inkjet printer, the nozzle plate comprising a first nozzle array having a plurality of nozzles, each of which is positioned to correspond to a desired print location, with the print location of each of the nozzles of the first nozzle array being different from one another; and a second nozzle array having a plurality of nozzles, each nozzle of the second nozzle array being positioned to correspond to a desired print location, with the print location of each of the nozzles of the second array corresponding to one of the print locations of the first nozzle array such that the first and second nozzle arrays each have a nozzle corresponding to each desired print location so that at least two nozzles are provided for each print location.

20. The nozzle plate of claim 19, wherein at least one of the nozzles is circular in cross section along an axis parallel to a plane defined by the nozzle plate.

21. The nozzle plate of claim 19, wherein at least one of the nozzles is square in cross-section along an axis parallel to a plane defined by the nozzle plate.

22. The nozzle plate of claim 19, wherein the nozzle plate includes from about 20 to about 20,000 nozzles.

23. The nozzle plate of claim 19, wherein the nozzle plate comprises a polyamide polymer and the nozzles are formed by laser ablation of the polyamide polymer.

24. The nozzle plate of claim 19, wherein the nozzles for each print location are in vertical alignment and horizontally spaced apart a distance of from about 20 to about 1000 $\mu$m.

25. The nozzle plate of claim 19, wherein the nozzles are arranged in spaced apart arrays, with each array containing a nozzle for each print location.

26. An inkjet printhead assembly for use with an inkjet printer, the printhead assembly comprising:

an ink reservoir, and a printhead attached to the reservoir, said printhead containing a plurality of nozzles on a nozzle plate for releasing ink from the printhead toward a medium to be printed, the nozzles being positioned at locations relative to the printhead corresponding to a plurality of desired print locations;

a plurality of resistance heater elements powered by electrical signals generated by a printer controller, each of the heater elements being positioned adjacent to and operatively associated with a nozzle for heating ink for release by the associated nozzle in response to an electrical signal received from the printer controller;

a plurality of ink chambers in flow communication with the reservoir and an associated nozzle for receiving ink to be heated;

at least one flow path for flowably directing ink from the reservoir to each of the chambers, wherein at least two nozzles and their associated heater elements, chambers and flowpath are provided for each print location.

27. The printhead assembly of claim 26, wherein each of the plurality of flowpaths has a length of from about 40 to about 300 $\mu$m.

28. The printhead assembly of claim 26, wherein the printhead is operable for each of the print locations by alternatively activating the heater elements of each print location.

29. The printhead assembly of claim 26, wherein at least one of the nozzles is circular in cross-section along an axis parallel to a plane defined by the nozzle plate.

30. The printhead assembly of claim 26, wherein at least one of the nozzles is square or rectangular in cross-section along an axis parallel to a plane defined by the nozzle plate.

31. The printhead assembly of claim 26, wherein the printhead includes from about 20 to about 20,000 nozzles.

32. The printhead assembly of claim 26, wherein the nozzles for each print location are in vertical alignment and horizontally spaced apart a distance of from about 20 to about 1000 $\mu$m.

33. The printhead assembly of claim 26, wherein the nozzles are arranged in spaced apart arrays, with each array containing a nozzle for each print location.

34. The printhead assembly of claim 33, wherein each array contains from about 10 to about 10,000 nozzles.

35. The printhead assembly of claim 34, wherein each array contains two rows of nozzles, with the rows spaced apart from one another by a distance of from about 20 to about 1000 $\mu$m.

36. The printhead assembly of claim 35, wherein each nozzle of each row is staggered relative to the nozzle immediately adjacent to it in the same row.

* * * * *

UNITED STATES PATENT AND TRADEMARK OFFICE

CERTIFICATE OF CORRECTION

PATENT NO. : 6,024,440
DATED : February 15, 2000
INVENTOR(S) : Ashok Murthy, et al.

It is certified that error appears in the above-identified patent and that said Letters Patent is hereby corrected as shown below:

Col. 6, line 62, replace "scissors icon" with -- ± ---.

Col. 7, line 22, replace "scissors icon" with -- ± --.

Col. 7, line 23, replace "scissors icon" with -- ± --.

Col. 7, line 25, replace "scissors icon" with --± --.

Col. 7, line 26, replace "scissors icon" with --± --.

Col. 7, line 27, replace "scissors icon" with --± --.

Col. 7, line 28, replace "scissors icon" with --±--.

Col. 7, line 29, replace "scissors icon" with --±--.

Signed and Sealed this

Twenty-first Day of November, 2000

*Attest:*

Q. TODD DICKINSON

*Attesting Officer*

*Director of Patents and Trademarks*